US008813835B2

(12) United States Patent
Diehl

(10) Patent No.: US 8,813,835 B2
(45) Date of Patent: Aug. 26, 2014

(54) METHOD AND DEVICE FOR THE "IN-SITU" CONVEYING OF BITUMEN OR VERY HEAVY OIL

(75) Inventor: Dirk Diehl, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 444 days.

(21) Appl. No.: 13/060,840

(22) PCT Filed: Jul. 17, 2009

(86) PCT No.: PCT/EP2009/059218

§ 371 (c)(1),
(2), (4) Date: Feb. 25, 2011

(87) PCT Pub. No.: WO2010/023035

PCT Pub. Date: Mar. 4, 2010

(65) Prior Publication Data

US 2011/0146981 A1 Jun. 23, 2011

(30) Foreign Application Priority Data

Aug. 29, 2008 (DE) ..... 10 2008 044 955

(51) Int. Cl.
*E21B 36/04* (2006.01)

(52) U.S. Cl.
USPC ..... 166/60; 166/302; 219/635; 392/306

(58) Field of Classification Search
USPC ..... 166/302, 272.1, 245, 60, 57; 219/603, 219/607, 614–617, 629, 635; 392/301–306, 392/465, 479, 485
See application file for complete search history.

(56) References Cited

U.S. PATENT DOCUMENTS

| | | | | |
|---|---|---|---|---|
| 4,116,273 | A | 9/1978 | Fisher | |
| 4,140,179 | A * | 2/1979 | Kasevich et al. | 166/248 |
| 4,144,935 | A * | 3/1979 | Bridges et al. | 166/248 |
| 4,449,585 | A * | 5/1984 | Bridges et al. | 166/248 |
| 6,581,684 | B2 * | 6/2003 | Wellington et al. | 166/245 |
| 7,115,847 | B2 | 10/2006 | Kinzer | |
| 2002/0056552 | A1 | 5/2002 | Berchenko | |
| 2007/0133960 | A1 | 6/2007 | Hsu | |
| 2007/0187089 | A1 | 8/2007 | Bridges | |
| 2007/0193744 | A1 | 8/2007 | Bridges | |
| 2011/0108273 | A1 * | 5/2011 | Huber et al. | 166/272.3 |

FOREIGN PATENT DOCUMENTS

| | | | |
|---|---|---|---|
| CN | 1806090 | A | 7/2006 |
| DE | 2634137 | A1 | 2/1978 |
| DE | 2636530 | A1 | 5/1978 |

(Continued)

*Primary Examiner* — Shane Bomar
*Assistant Examiner* — Catherine Loikith

(57) ABSTRACT

A method for the "in situ" extraction of bitumen or very heavy oil is provided. An electric/electromagnetic heater to reduce the viscosity of bitumen or very heavy oil with at least two linearly expanded conductors are configured in a horizontal alignment at a predetermined depth of the reservoir. The conductors are connected to each other in an electrically conducting manner inside or outside of the reservoir, and together form a conductor loop, and are connected to an external alternating current generator outside of the reservoir for electric power. The heating of the reservoir is predetermined in a chronologically and/or locally variable manner in accordance with the electric parameters, and may be changed outside of the reservoir for optimizing the feed volume during the conveying of the bitumen. At least one generator is present in the related device, wherein the parameters thereof are variable for the electric power.

20 Claims, 4 Drawing Sheets

(56) References Cited

FOREIGN PATENT DOCUMENTS

| | | | |
|---|---|---|---|
| DE | 102007008292 | A1 | 8/2008 |
| DE | 102007040605 | B3 | 10/2008 |
| DE | 102007036832 | A1 | 2/2009 |
| EA | 004096 | B1 | 12/2003 |
| EA | 004326 | B1 | 4/2004 |
| EA | 012931 | B1 | 2/2010 |
| RU | 2097544 | C1 | 11/1997 |
| RU | 2215872 | C2 | 11/2003 |
| WO | WO 2007084763 | A2 | 7/2007 |
| WO | WO 2008098850 | A1 | 8/2008 |
| WO | WO 2009027305 | A2 | 3/2009 |

* cited by examiner

METHOD AND DEVICE FOR THE "IN-SITU" CONVEYING OF BITUMEN OR VERY HEAVY OIL

CROSS REFERENCE TO RELATED APPLICATIONS

This application is the US National Stage of International Application No. PCT/EP2009/059218, filed Jul. 17, 2009 and claims the benefit thereof. The International Application claims the benefits of German application No. 10 2008 044 955.5 DE filed Aug. 29, 2008. All of the applications are incorporated by reference herein in their entirety.

FIELD OF INVENTION

The invention relates to a method for the "in-situ" extraction of bitumen or very heavy oil from oil sand deposits as a reservoir, as claimed in the claims. In addition, the invention also relates to the associated device for implementation of the method.

BACKGROUND OF INVENTION

For the extraction of very heavy oils or bitumen from oil sand or oil shale deposits by means of pipe systems which are introduced through boreholes, the fluidity of the raw materials which are present in a solid consistency has to be increased considerably. This can be achieved by increasing the temperature of the deposit in the reservoir.

If inductive heating is used for this purpose exclusively or in support of the usual SAGD (Steam Assisted. Gravity Drainage) process, the problem arises that adjacent inductors which are supplied with current simultaneously can have a negative effect on one another. For example, adjacent inductors which are supplied with current in opposing directions weaken one another in terms of the thermal energy deposited in the reservoir.

In the German patent applications DE 10 2007 008 292, DE 10 2007 036 832, and DE 10 2007 040 605, individual inductor pairs, i.e. forward and return conductors, are supplied in a predetermined geometric configuration with current in order to heat the reservoir inductively. The current strength is used for adjusting the desired the final output while the phase position is fixed at 180° between adjacent inductors. This supply of current in phase opposition follows necessarily from running an inductor pair comprising forward and return conductor to a generator. In a parallel patent application by the applicant designated "System for the in-situ extraction of a substance comprising hydrocarbons", among other things, the control of the heat output distribution in an array of inductors is described, this being achieved through the adjustability of the current amplitudes and phase position of adjacent inductor pairs. All previous patent applications assume that the supply of current over lengthy time periods of from days to months undergoes only minor adjustments and that a generator is permanently assigned to an inductor pair.

SUMMARY OF INVENTION

Proceeding on this basis, the object of the invention is to propose suitable methods and to provide associated devices which will serve to improve efficiency in the extraction of bitumen or very heavy oil from oil sand or oil shale reservoirs.

The object is achieved in a method of the type referred to in the introduction in the measures described in the claims. An associated device is described in the claims. Further developments of the method and of the associated device are the subject matter of the respective dependent claims.

The subject matter of the invention is to configure the key parameters of the necessary electric power generators for the electric heating of the reservoir in a chronologically and/or locally variable manner and to provide the possibility of changing these parameters from outside the reservoir in order to optimize the extraction volume during the extraction of the bitumen or very heavy oil. This creates very far-reaching possibilities for controlling the supply of current to the inductors in that locally measured temperatures, in particular, can also be used as control variables. In addition, the temperatures in the reservoir can be measured in a locally distributed manner, for example on the individual inductors, but optionally also outside the reservoir, namely, in the overburden, i.e. in the area of rock above the reservoir, or in the underburden, i.e. in the area of rock below the reservoir.

In detail, the invention includes a wide range of different possible combinations of individually energizable inductors and of generators which can be assigned to these inductors. In particular, the following steps are possible:

The invention proposes implementing the supply of current to adjacent inductors in a chronologically sequential manner and using forward and return conductors which are preferably located spatially far apart. For this purpose, the chronologically sequential switching of four inductor pairs is shown further below by way of example. The inductors, which serve as forward and return conductors, can be selected by means of individual switches.

The supply of current to the inductor pairs can, for example, take place over identical time portions. Due to the high heat capacities of the reservoir, long time intervals in the region of hours or days can be chosen, provided the thermal loading capacity of the inductors is not exceeded.

The time portions for the supply of current can be chosen so as to be different for the individual inductor pairs and can be changed during different phases of exploitation of the reservoir.

The combination of forward and return conductors forming an inductor pair can be changed during different phases of exploitation of the reservoir.

The temperature of the inductors and/or that of the reservoir surrounding them can be used for controlling the time intervals and for putting the inductors together into forward and return conductor pairs. In this way, preference can be given to supplying current to inductors with a low thermal loading and/or to heating reservoir areas which are low in temperature.

The formation of an inductor pair can be used to influence the heat output proportions in the overburden, reservoir and underburden. During different chronological phases of exploitation of the reservoir, the two types of current supply—chronologically sequential or simultaneous current supply with multiple generators—can be switched between.

The lines can be configured to run in close spatial proximity to one another through the overburden on the generator and/or connection side in order to prevent or reduce undesired heating of the overburden.

Instead of the switches to forward and return conductors, multiple permanently connected generators can be used which can be operated chronologically sequentially or simultaneously at the same or different frequencies.

When current is supplied to adjacent inductors at different frequencies, no cancellation effects occur and the overall heat output (and its distribution) is given by the sum of the heat outputs (and their distributions) of the individual inductors.

The effective resistance which the reservoir constitutes as a secondary winding is very much higher with respect to forward and return conductors that are located far apart than in the case of closely adjacent conductors, as a result of which high thermal outputs can be introduced into the reservoir by means of comparatively small currents in the inductor (primary winding).

When the generators are operated at different frequencies, an inductive coupling of the generators with fundamentals and harmonics is preferably avoided, as this could otherwise lead to malfunctions of and/or high loads on the generators.

The capacitatively compensated inductors have basically to be produced so as to match the respective operating frequency. If the generators can deliver a small part of the total reactive power to be applied, or if the compensation thereof can be effected directly on the generator through capacitative and/or inductive connections, uniform inductor designs that are matched to an average operating frequency can be used. With the aid of these external compensation circuits, inductors which are otherwise identical can be operated at slightly different frequencies, which is sufficient to prevent cancellation effects.

The invention is based on the findings obtained from detailed studies that substantial advantages over the prior art can be attained by means of the steps described hereinabove. These are, in particular:

Re: 1: The effective resistance of the inductive reservoir heating is increased considerably, for example by a factor of 4. This means that, for current of the same amplitude into the inductor, the heat output in the reservoir can have a value four times higher compared to current supplied simultaneously.

Within the scope of the invention, model calculations were carried out: in accordance with the Finite Elements Method (FEM), a model containing just one conductor pair was taken as a basis, four such sections being arranged adjacent to one another and one further section containing no inductors forming the left and right boundary regions, respectively.

Together, a 2D FEM model advantageously emerges comprising eight individual inductors which, for example, foam four separate inductor pairs (1/5), (2/6), (3/7) and (4/8), as well as associated boundary regions. This 2D FEM model can be used for investigating the heat output distribution when different currents are supplied.

Calculations then yield a suitable heat output distribution where a first inductor serves as a forward conductor and an inductor located as far as possible therefrom serves as a return conductor. The total heat output is P1 in W/m if the inductors are constantly supplied with a current of a predetermined amplitude I1 at a predetermined frequency f1. A frequency of 10 kHz is preferably taken as the basis, with frequencies between 1 and 500 kHz being suitable in principle.

If all the inductors are simultaneously supplied with current of the same current amplitude I1 at the same frequency f1, the result is a different heat output distribution. The currents of adjacent inductors each exhibit a phase shift of 180°. However, the total heat output amounts again to approximately P1 in W/m.

Re. 2: If in the example described under item 1, for example, four individual inductor pairs (1/5), (2/6), (3/7) and (4/8) are each supplied with current for one quarter (25%) of the time, then for this purpose only one generator (converter) is needed which can supply the necessary current of the specified current amplitude (1350 A) with four times the effective power, but without the reactive power demand increasing. Thus, the mean heat output introduced into the reservoir over time would be the same as in the case of current supplied simultaneously, as described under item 1. This means that instead of four generators which each have to provide ¼ of the required heat output as effective power and, in addition, a reactive power depending on the inductor, only one generator is needed with four times the effective power, without the demand for reactive power increasing.

Re. 3: Control of the heat output distribution can now be achieved in accordance with the particular requirements. Thus, for example, inhomogeneities in the temperature distribution due to uneven heating through steam injection can, up to a point, be compensated for.

Re. 4: As under item 3, control of the heat output distribution can thus be effected.

Re. 5: The variation of the current supply over time in combination with the flexible choice of forward and return conductor can advantageously be used to protect the inductors from excessive temperature due to their ohmic losses that occurs in addition to external heating by the reservoir.

Re. 6: The heat output proportions in overburden, reservoir and underburden can be influenced up to a point through the supply of current to the inductors. This is examined in detail further below.

Re. 7: The losses in the overburden can be minimized by means of the latter steps. The bringing of all the lines through the overburden together allows a flexible arrangement of forward and return conductor together with the advantages as described under items 3-6.

Re. 8: Advantageously, a simple switching of the types of current supply is now possible.

Re. 9: It is alternatively proposed that current be supplied to adjacent inductors simultaneously but at different frequencies. By way of example, the connection of four inductor pairs to four generators of different frequency is possible.

Re. 10: Each generator feeds a forward/return conductor pair of inductors, the individual conductors lying spatially as far as possible from one another.

Re. 11: The frequencies of the generators involved should not in the case of the latter procedure be integer multiples of one another.

Re. 12: The frequencies of the generators involved can be nearly equal, e.g. deviate from one another by less than 5%.

BRIEF DESCRIPTION OF THE DRAWINGS

Further details and advantages of the invention will emerge from the description of the figures below of exemplary embodiments based on the drawings in conjunction with the claims.

DETAILED DESCRIPTION OF INVENTION

Figure 1:
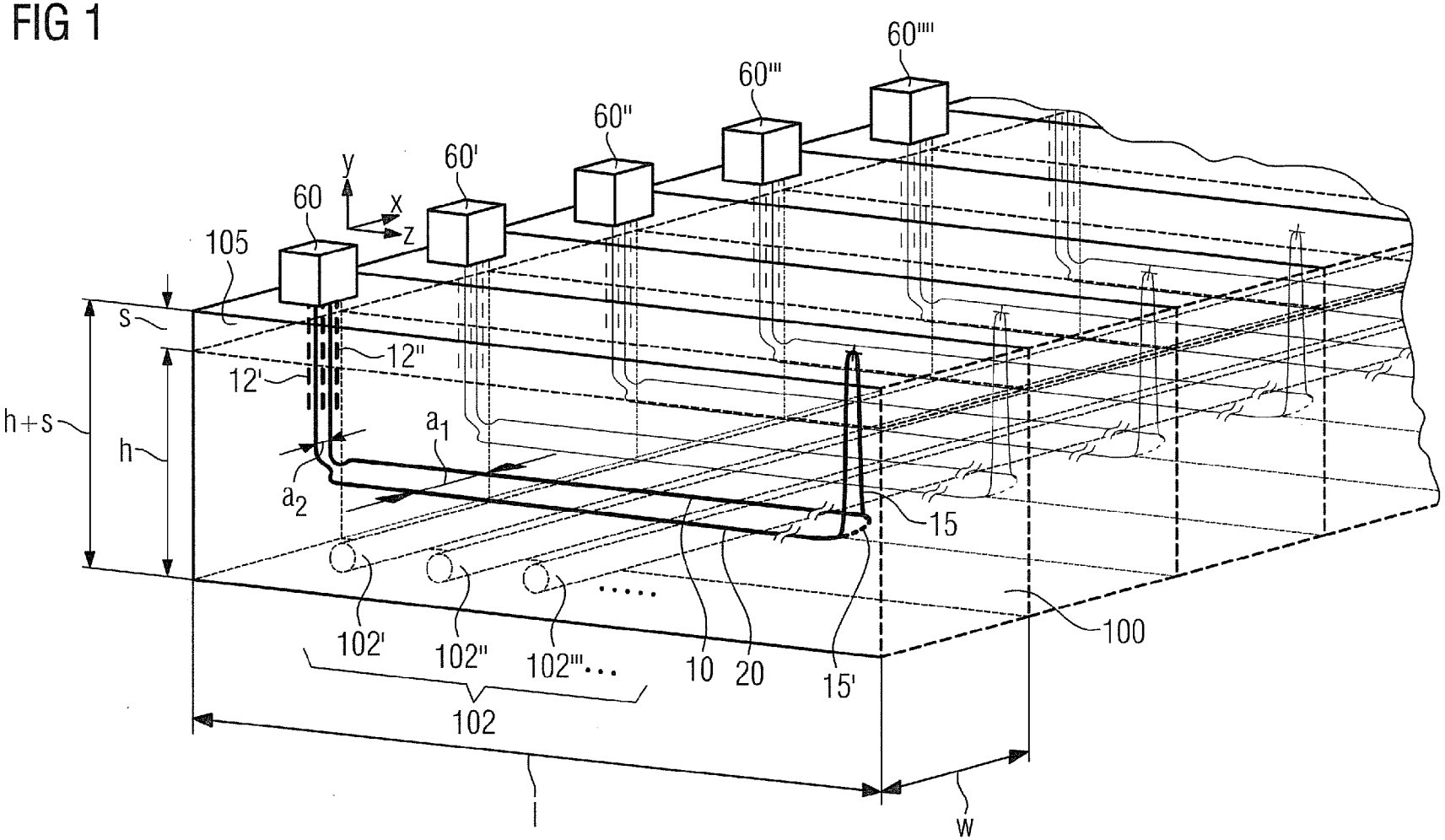
FIG. 1 shows a section from an oil sand deposit comprising repeating units as the reservoir and a respective electrical conductor structure running horizontally in the reservoir.
Figure 2:
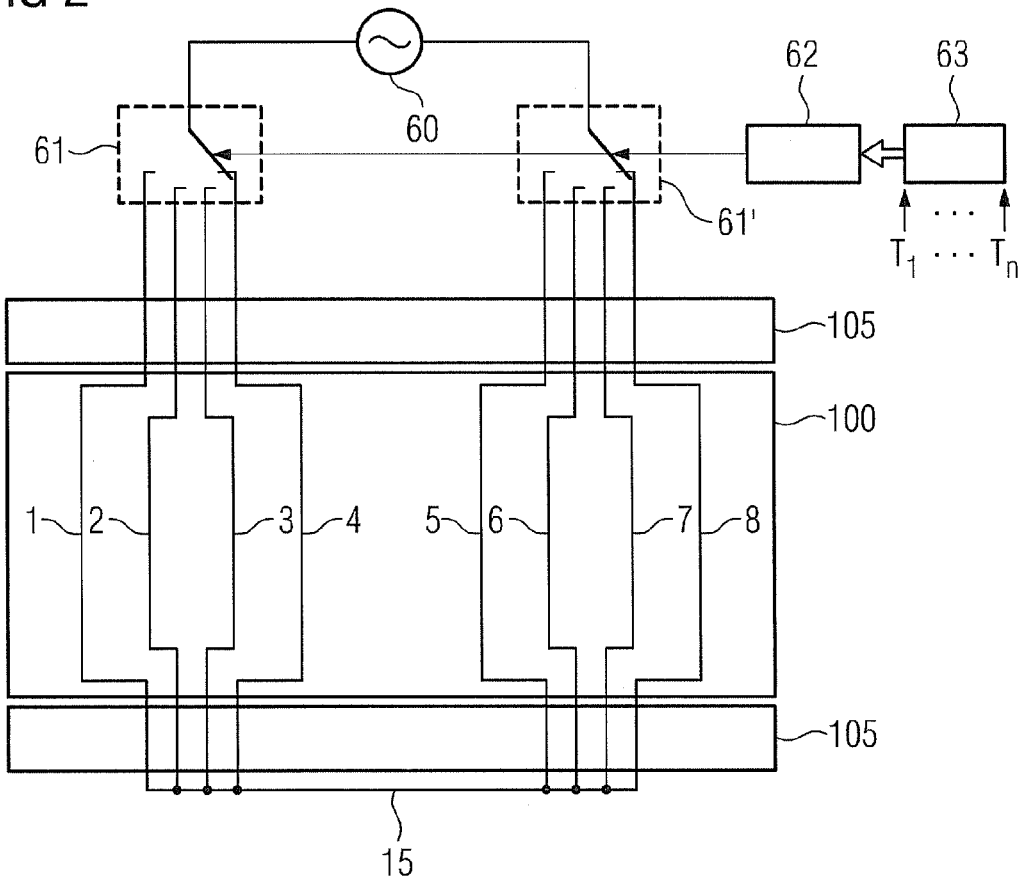
FIG. 2 shows the schematic layout of the circuit arrangement of four inductor pairs with a chronologically sequential current supply.
Figure 3:
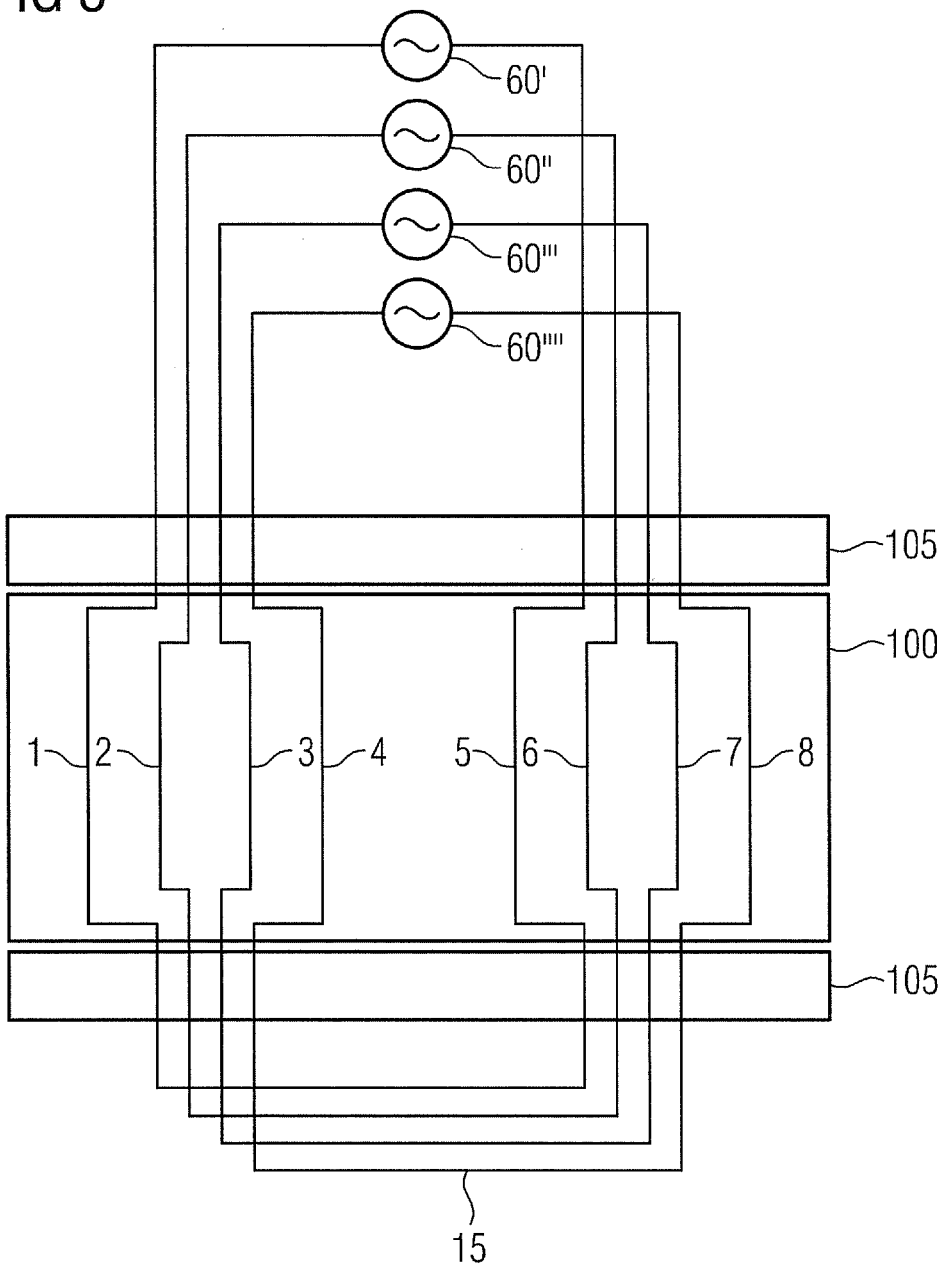
FIG. 3 shows the schematic layout of the circuit arrangement of four inductor pairs with a simultaneous current supply by means of separate generators which may have different frequencies, the associated forward and return conductors lying spatially far from one another
Figure 4:
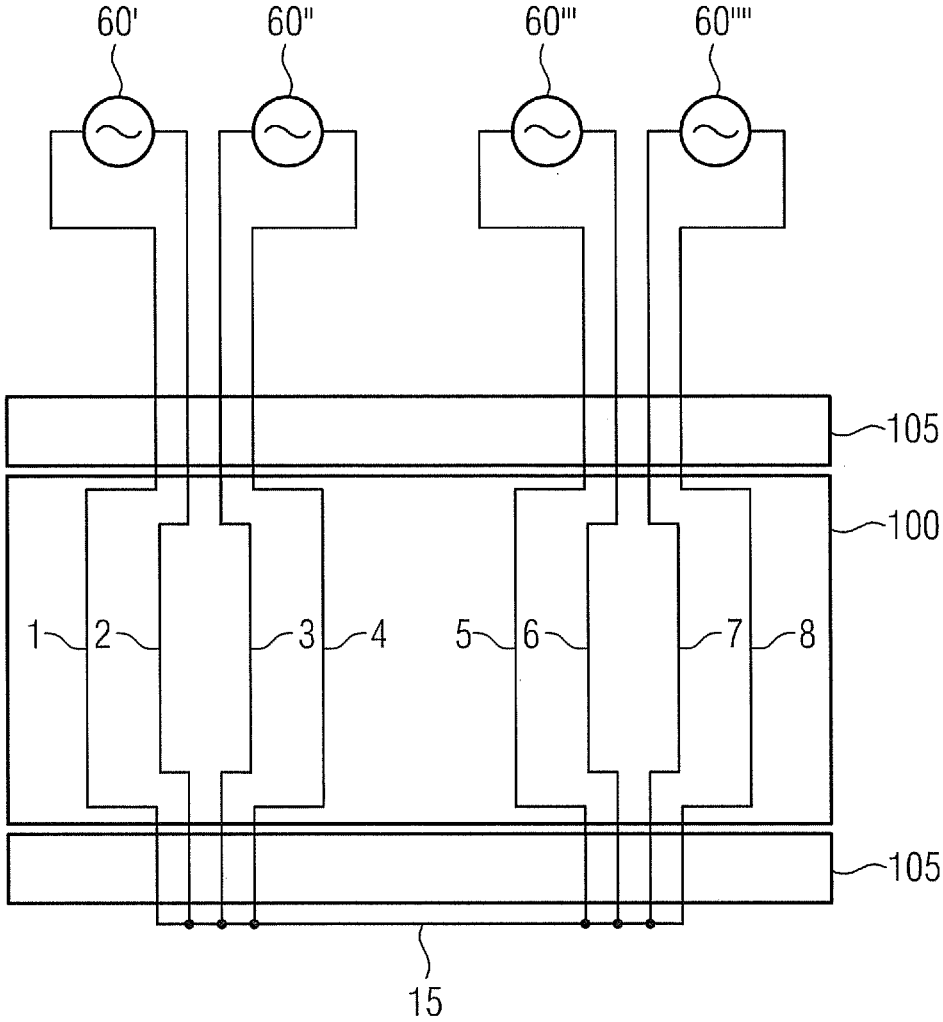
FIG. 4 shows the schematic layout of the circuit arrangement of four inductor pairs with separate generators of different frequencies, the associated forward and return conductors lying near to one another.

Whereas FIG. 1 shows a perspective representation as a linearly repeating arrangement (array), FIGS. 2 to 4 are in each case top views, i.e. horizontal sections in the inductor plane seen from above, the overburden being located on the two opposing sides. The same elements in the figures have the same reference characters. The figures are described, in part jointly, below.

FIG. 1 shows an underground oil sand incidence (layer) forms the reservoir wherein elementary units having a length l, height h and width w are shown one behind the other or alongside each other. Above, the reservoir 100 is a capping layer 105 (overburden) having a thickness s. Corresponding layers (underburden) are located below the reservoir 100, but are not individually identified in FIG. 1. The inductor lines 10, 20 are guided in the reservoir 100 at the predefined distance $a_1$ in an essentially parallel and horizontal manner. The distance $a_2$ between the forward conductor and the return conductor in the vertical region is as small as possible. Two boreholes 12, 12' are present having a distance of less than 10 m.

For the extraction of very heavy oils or bitumen from oil sand or oil shale deposits by means of pipe systems 102 which are introduced through boreholes into the oil deposit, the fluidity of the solid-like bitumen or of the viscous very heavy oils has to be improved considerably. This can be achieved by increasing the temperature of the deposit (reservoir), the effect of which is a lowering of the viscosity of the bitumen or very heavy oil.

The applicant's earlier patent applications were aimed primarily at using inductive heating to support the usual SAGD process. The forward and return conductors of the inductor lines, which together form the induction loop, are arranged at a comparatively large interval of, for example, 50-150 m. The reciprocal weakening of the forward and return conductors which are supplied with current in opposing directions is in this case small and can be tolerated.

Increasingly, EMGD processes are being considered in which inductive heating is to be used as the only method of heating the reservoir, without the introduction of hot steam, which brings with it the advantage among others of reduced or practically zero water consumption.

Where inductive heating alone is used, the inductors have to be arranged nearer to the bitumen production pipe so as to enable an early production start with simultaneously reduced pressure in the reservoir. In this way, the forward and return conductors likewise move closer together. This brings with it the problem that the reciprocal field weakening of the forward and return conductors which are fed with current in opposing directions is considerable and results in decreased heat output. While this can in principle be compensated for by higher inductor currents, this would, however, increase the demands on the conductors in terms of current-carrying capacity and thus considerably increase the production cost thereof.

It is possible to supply current to conductors which are spatially closely adjacent in a chronologically sequential, i.e. non-simultaneous, manner, as a result of which the problem of field weakening does not arise. It is advantageous here that one generator (converter) can be used for multiple conductor loops. A disadvantage, however, is that the inductors are supplied with current only for a fraction of the time and only then contribute to the heating of the reservoir. This is illustrated further below with the aid of FIGS. 2 to 4.

FIG. 1 shows an arrangement for inductive heating. This can comprise a long, i.e. from several hundred meters up to 1.5 km long, conductor loop 10 to 20 laid in a reservoir 100, the forward conductor 10 and return conductor 20 running alongside one another, i.e. at the same depth at a predetermined distance, and being connected at the end via an element 15 or 15' as the conductor loop inside or outside the reservoir 100. Initially, the conductors 10 and 20 lead vertically or at a predetermined angle downward in boreholes through the overburden and are supplied with electric power by an HF generator 60 which can be accommodated in an external housing.

In particular, the conductors 10 and 20 run at the same depth either alongside one another or above one another. It may be useful for the conductors to be offset. Typical distances between the forward and return conductors 10, 20 are 10 to 60 m, the conductors having an external diameter of 10 to 50 cm (0.1 to 0.5 m).

An electric two-conductor line 10, 20 in FIG. 1 having the above-mentioned typical dimensions has a longitudinal inductance per unit length of 1.0 to 2.7 μH/m. The transverse capacitance per unit length, at the dimensions stated, lies at only 10 to 100 pF/m so that the capacitive transverse currents are initially negligible. Wave effects must be prevented. The wave velocity is given by the capacitance and inductance per unit length of the conductor arrangement.

The characteristic frequency of an inductor arrangement from FIG. 1 is determined by the loop length and the wave propagation velocity along the arrangement of the two-conductor line 10, 20. The loop length should therefore be chosen so as to be sufficiently short that no interfering wave effects are produced here.

FIG. 2 shows how four inductor pairs can be switched with a chronologically sequential current supply. 60 again designates the high-frequency power generator whose outputs are given to switching units 61, 61'. The switching units 61, 61' each have four different contacts, the switching unit 61 being connected to four inductors 1, 2, 3, 4 as the forward conductors and the switching unit 61' being connected to four inductors 5, 6, 7, 8 as return conductors. A switching clock 62 provides for the switching or connection of the generator voltage to the individual lines 1 to 8.

The individual inductors 1 to 8 are arranged in accordance with FIG. 1 in the reservoir 100. On both sides of the reservoir 100 there are areas 105 which are not to be heated and which phenomenologically represent the overburden. Furthermore a connection 15 is connected to the ends of the inductors which connects the forward and return conductors to one another. The connection 15 may be arranged above or below ground.

With the latter arrangement, it is possible for individual adjacent areas of the reservoir each to be heated in a controlled manner. This can, in particular, be carried out chronologically successively, i.e. sequentially. The switching clock 62 can be controlled by a separate control unit 63 which, in particular, takes into account the temperature T in the reservoir 100. To this end, temperature sensors (not shown in FIG. 2) can, for example, be positioned on the individual inductors or inductor lines in order to measure local temperatures $T_i$ there and to transmit these to the control unit 63 for analysis. In this way, account can be taken, in particular, of excessive temperatures on the inductors.

It is, however, also possible to measure the temperatures locally at other points in the reservoir 100 or even in the overburden and/or underburden and to take these into account in the activation of the generators. An essential aspect here is that the power output of the generators can in this way be altered and adapted to the particular requirements which change in the phases of exploitation of the deposit over time. This applies in particular because the exploitation time phases are long, for example years or more.

In FIG. 3, the arrangement according to FIG. 2 has been modified to the effect that four high-frequency power generators 60', 60", 60'" and 60"" are present, each of which controls two of the inductors 1 to 8 in pairs. An above-ground or below-ground connection 15 is again present. This arrangement makes it, in particular, possible to supply current at different current strengths and of different frequencies to four inductor pairs simultaneously.

An arrangement according to FIG. 3 can be modified such that different frequencies can also be used. This is shown in FIG. 4, in which eight inductors 1 to 8 are again arranged parallel to one another in the reservoir. Two of the inductors 1 to 8 are in each case controlled by a separate generator 60' to 60"". In this case, generators are chosen such as generate differently predeterminable frequencies. For example, generator 60' has the frequency $f_1$, generator 60" the frequency $f_2$, generator 60''' the frequency $f_3$, generator 60"" the frequency $f_4$. The supply with currents of different frequencies means that the individual areas are now heated differently in a targeted manner.

With the aid of the examples, it has been shown that the heat output proportions in the overburden (OB), reservoir 100 and underburden (UB) can up to a point be influenced by means of a differentiated current supply to the inductors. These proportions are, in conclusion, reproduced for an example examined in detail:

a: If, for example, current is supplied to the inductors 1 to 5, for example, a percentage loss distribution is obtained of:

OB 31.3%, reservoir 45.5% and UB 23.2% b: If current is supplied simultaneously to all the inductors, the following is obtained by contrast:

OB 24.2%, reservoir 62.8% and UB 13.0%

The latter signifies that the greatest proportion of the heat output is deposited in the reservoir when current is supplied simultaneously to the inductors, with a phase shift of $\phi=180$ between adjacent inductors. Switching between the types of current supply may therefore be advantageous depending on the chronological progress of exploitation of the deposit, in particular depending on the desired heat output distribution of the generators and/or on the number of generators used.

In conclusion, it should be pointed out that where the power generator is arranged outside the reservoir, an underground installation of the generator is also possible, which may under certain circumstances be advantageous. In this case, the electric power would then be conducted downward at low frequency, i.e. 50-60 Hz or possibly even as direct current, and conversion to the kHz range could possibly take place underground, so no losses would occur in the overburden.

It can be stated overall that the key electric parameters for heating the reservoir can be predetermined in a chronologically and/or spatially variable manner and can be changed from outside the reservoir in order to optimize the extraction volume during the extraction of bitumen. At least one generator is present in the associated device, though multiple generators are preferred, the electric parameters ($I$, $f_i$, $\phi$) thereof being variable.

The invention claimed is:

1. A method for the "in-situ" extraction of bitumen or heavy oil from oil sand deposits as a reservoir, comprising:

applying thermal energy to the reservoir to reduce the viscosity of the bitumen or heavy oil;

providing an electric/electromagnetic heater and an extraction pipe;

leading away the liquefied bitumen or heavy oil using the extraction pipe;

configuring a plurality of linearly expanded conductors arranged in inductor pairs including a forward and a return conductor, the inductor pair disposed at least in portions parallel in a horizontal alignment at a same predetermined depth of the reservoir; and connecting the ends of the forward conductor and return conductor to each other forming the induction pair in an electrically conducting manner inside or outside the reservoir and together the ends form a conductor loop, and are connected to an external alternating current generator outside the reservoir for electric power, wherein a plurality of key parameters for the electric/electromagnetic heating of the reservoir are chronologically variable and are changed from outside the reservoir to optimize an extraction volume during the extraction of the bitumen or heavy oil, wherein multiple power generators are used, each of which supplies current to the induction pair, whereby phase positions of the electric currents relative to one another are variable and are adapted to a plurality of particular requirements, and wherein the current supplied to the inductor pair is between the frequency range of 1 to 500 kHz.

2. The method as claimed in claim 1, wherein inductive heating of the reservoir is effected through the introduction of electric power of a power generator via a plurality of lines and inductors, and wherein the electric power of the power generator is variable and is altered and adapted to the plurality of particular requirements during the extraction of the bitumen or heavy oil.

3. The method as claimed in claim 2, wherein a supply of current to the plurality of inductors is changed at different chronological phases of exploitation of the oil sand deposit.

4. The method as claimed in claim 2, wherein the power generator for the inductive heating is operated at different frequencies.

5. The method as claimed in claim 1, wherein output currents of the power generator are variable and are altered and adapted to a plurality of particular requirements during the extraction of the bitumen or heavy oil.

6. The method as claimed in claim 1, wherein the temperatures inside the reservoir are measured locally and are used for controlling a plurality of current amplitudes of the power generators.

7. The method as claimed in claim 6, wherein the temperature of the reservoir is measured locally at the plurality of inductors.

8. The method as claimed in claim 7, wherein an upper temperature limit of the plurality of inductors and line connections are used for controlling the chronologically sequential supply of current.

9. The method as claimed in claim 7, wherein the temperature at the plurality of inductors is used for controlling an amplitude of the currents flowing through the plurality of inductors.

10. The method as claimed in claim 1, wherein the temperatures outside the reservoir are measured and used for control purposes.

11. The method as claimed in claim 1, wherein areas of the oil sand deposit which have not been exploited are opened up by means of the plurality of inductors subsequently introduced into the reservoir.

12. A device for implementing the method as claimed in claim 1, comprising:

a plurality of lines configured in a reservoir as separate inductor pairs comprised of a plurality of conductors each including a forward and return conductor whose ends are connected,each inductor pair is assigned outside the reservoir to a power generator that generates electric power, wherein the inductor pairs are disposed at least in portions parallel in a horizontal alignment at a same predetermined depth of the reservoir, wherein the power generator is variable in terms of a plurality of parameters that determine an output power of the power generator, wherein a plurality of conductor loops each including the inductor pair and a connection are fitted with a plurality of temperature sensors for measuring temperatures, wherein the plurality of temperature sensors are arranged for the purpose of measuring the temperatures inside or outside the reservoir and are used for chronologically sequential control, and wherein the current supplied to the inductor pair is between the frequency range of 1 to 500 kHz.

13. The device as claimed in claim 12, wherein means are available for a sequential connection of the individual outputs of the power generator to the plurality of inductors.

14. The device as claimed in claim 12, wherein the power generator includes individual outputs for different frequencies.

15. The device as claimed in claim 12, wherein the multiple generators are available for different frequencies.

16. The device as claimed in claim 12, wherein the plurality of conductors for the electromagnetic heating include a conductor loop.

17. The device as claimed in claim 12, wherein external switching means are available, each of which connect different inductor lines to form an inductor loop.

18. The device as claimed in claim 17, wherein an interval of the plurality of inductor lines and thus of the introduced heating power is selected through switching by means of the external switching means.

19. The device as claimed in claim 12, wherein the plurality of temperature sensors are arranged for the purpose of measuring the temperatures inside or outside the reservoir and are used for current amplitude control of the power generator.

20. A method for the "in-situ" extraction of bitumen or heavy oil from oil sand deposits as a reservoir, comprising:

applying thermal energy to the reservoir to reduce the viscosity of the bitumen or heavy oil;

providing an electric/electromagnetic heater and an extraction pipe;

leading away the liquefied bitumen or heavy oil using the extraction pipe;

configuring a plurality of linearly expanded conductors arranged in inductor pairs including a forward and a return conductor, the inductor pair disposed at least in portions parallel in a horizontal alignment at a same predetermined depth of the reservoir; and connecting the ends of the forward conductor and return conductor to each other forming the induction pair in an electrically conducting manner inside or outside the reservoir and together the ends form a conductor loop, and are connected to an external alternating current generator outside the reservoir for electric power, wherein a plurality of key parameters for the electric/electromagnetic heating of the reservoir are chronologically variable and are changed from outside the reservoir to optimize an extraction volume during the extraction of the bitumen or heavy oil, wherein the temperatures inside the reservoir are measured locally and are used for controlling a chronologically sequential supply of current to the inductors, and wherein the current supplied to the inductor pair is between the frequency range of 1 to 500 kHz.

* * * * *